US005967400A

United States Patent [19]

Bell et al.

[11] Patent Number: 5,967,400

[45] Date of Patent: Oct. 19, 1999

[54] METHOD OF FORMING METAL MATRIX FIBER COMPOSITES

[75] Inventors: James Alexander Evert Bell, Oakville; Kirt Kenneth Cushnie; Anthony Edward Moline Warner, both of Burlington, all of Canada; George Clayton Hansen, Midway, Utah

[73] Assignee: Inco Limited, Toronto, Canada

[21] Appl. No.: 08/980,494

[22] Filed: Dec. 1, 1997

[51] Int. Cl.[6] ..... B23P 17/04

[52] U.S. Cl. ..... 228/124.5; 228/121; 228/122.1; 228/124.1; 228/190; 228/208; 228/209

[58] Field of Search ..... 228/121, 122.1, 228/124.1, 208, 209, 190, 124.5

[56] References Cited

U.S. PATENT DOCUMENTS

| | | | |
|---|---|---|---|
| 3,894,677 | 7/1975 | La Iacona | 228/190 |
| 3,918,141 | 11/1975 | Pepper et al. | 29/419 R |
| 3,953,647 | 4/1976 | Brennan et al. | 428/378 |
| 4,489,138 | 12/1984 | Yamatsuta et al. | 428/614 |
| 4,761,206 | 8/1988 | Forrest | 204/9 |
| 4,831,707 | 5/1989 | Goddard et al. | 29/419.1 |
| 5,326,525 | 7/1994 | Ghosh | 419/23 |
| 5,385,195 | 1/1995 | Bell et al. | 164/66.1 |
| 5,501,906 | 3/1996 | Deve | 428/366 |

OTHER PUBLICATIONS

Baker et al., "Carbon–fibre/metal–matrix composites: fabrication by electrodeposition," COMPOSITES, (1971) pp. 154–160.

Lamotte et al., "Continuously Cast Aluminum–Carbon Fibre Composites and their Tensile Properties," Journal of Materials Science 7 (1972), pp. 349–349.

Pepper et al., "Mechanical Properties of Aluminum–Graphite Composites Prepared by Liquid Phase Hot Pressing," J. Composite Materials, vol. 8 (1974) pp. 29–36.

Pepper et al., "Development and Evaluation of Aluminum–Graphite Fine Wire and Strip (RIBBON)," U.S. Contract N00024–75–C–5067 (1975).

Pierson, "Aluminum Coatings by the Decomposition of Alkyls," Thin Solid Films, 45 (1977) pp. 257–263.

Ohsaki et al., "The Properties of Carbon Fiber Reinforced Aluminum Composites Formed by the Ion–Plating Process and Vacuum Hot Pressing, " Thin Solid Films, 45(1977) pp. 563–568.

Suzuki et al., "Formation of Al Films on Pitch–base Carbon Fibers from Tri–iso–butyl Aluminum by the Reduced–pressure CVD," Auger elcetron spectroscopy, tensile testing of monofilament, (1986) pp. 577–583.

Sikka et al., "Processing and Mechanical Properties of $Ni_3Al$–Based Intermetallic Composites, PLM Aerosp. Def. Technol. Proc.," (1991) pp. 137–145.

Bell et al., "Nickel–Coated Carbon Fiber Preforms for Metal Matrix Composites," 3rd International SAMPE Metals Processing Conference (1992).

Nishiyama et al., "Fabrication and Mechanical Properties of Cf NiAl and siCw/NiAl Composites," Proc. Jpn. U.S. Conf. Compos. Mater. 6th (1993) pp. 417–424.

*Primary Examiner*—Patrick Ryan
*Assistant Examiner*—Kiley Stoner
*Attorney, Agent, or Firm*—Blake T. Biederman; Edward A. Steen

[57] ABSTRACT

The method provides a process for fabricating metal matrix composites. First the process coats the fibers with nickel by electrodeposition or gaseous deposition to form nickel-coated fibers. Over-plating the nickel-coated fibers with aluminum by either electrodeposition in a non-aqueous electrolyte or gaseous deposition forms aluminum-coated-nickel-coated fibers. Sintering this product under compression, perpendicular to the fiber's central axis, forms the final metal matrix composite. The metal matrix composite has a nickel-aluminum matrix, very few voids and extended unbroken lengths of fibers within the nickel-aluminum matrix.

16 Claims, 2 Drawing Sheets

METHOD OF FORMING METAL MATRIX FIBER COMPOSITES

FIELD OF THE INVENTION

This invention relates to a method of forming aluminum-base matrix carbon fiber composites. In particular, this invention relates to a method of forming carbon fiber composites in a nickel-aluminum matrix.

BACKGROUND OF THE INVENTION

Many methods for preparation of metal matrix composites containing carbon fibers have been attempted. The reason for this interest is because of the high strength of these fibers—3.5 to 6.5 GPa (500 to 970 ksi) with a specific gravity of 1.76 to 1.81. The specific high strength and modulus of these fibers have led to sales of over 15,000,000 lbs in epoxy and plastic composites. These fibers are around 7 micrometers in diameter and come with 3000, 6000 or 12000 filaments per tow wound onto spools. The fibers' main applications consist of epoxy composites used in aerospace and sporting goods.

The primary limiting characteristic of these organic matrix composites is their inability to function at temperatures much over 200° C. For use at higher temperatures, researchers have developed methods to prepare carbon fiber composites utilizing an aluminum-based matrix. Methods discussed in prior literature include the following:

(a) liquid metal infiltration of aluminum around carbon fiber by squeeze casting;

(b) physical vapor deposition, chemical vapor deposition, plasma spraying or electrolytic plating of aluminum onto carbon fibers and hot pressing the aluminum-coated carbon fibers; and (c) $TiB_2$ or nickel coating a carbon fiber tow, then drawing the coated tow through molten aluminum and hot pressing the aluminum-coated tow.

Aluminum Matrix Methods

The following paragraphs describe known techniques for producing aluminum matrix composites strengthened by carbon fibers:

Pressure Infiltration—this has been used commercially to make $Al_2O_3$ fiber composites. These techniques however, are less successful when applied to carbon fibers. Because molten aluminum does not wet carbon fibers, this process requires high infiltration pressures, increasing cost. One method to lower this high infiltration pressure is to use a nickel-coated carbon fiber preform as shown by Bell et al. in "Nickel-Coated Carbon Fiber Preforms for Metal Matrix Composites" 3rd International SAMPE Metals Processing Conference (1992), Vol. 24 (Advancements in Synthesis and Processes) Toronto, Canada, Oct. 20–22 (1992). The nickel coating allows the aluminum to easily wet the preform, thereby lowering the required infiltration pressure. While these alloys have some utility in high wear applications, this technique only incorporates a low volume fraction of fiber. Furthermore, this relatively low fiber content corresponds to a low composite strength.

Carbon Fiber Tows—pre-coating these fibers with aluminum by ion plating, plasma spraying tows wound on a drum, electrolytic plating or chemical vapor deposition, each followed by hot pressing to form an article.

Melt Drawing—pulling bundles of carbon fiber precoated with nickel into an aluminum matrix is also possible. Again, tows can be subsequently hot pressed together. The mechanical properties however do not reach those expected under the rule of mixtures due to the formation of an embrittling $Al_3Ni$ phase.

Unfortunately, these aluminum-based matrix carbon fiber composites have several inherent limitations. First, aluminum and carbon will react to form $Al_4C_3$ at temperatures greater than 600° C. This carbide is very detrimental to the mechanical properties of the composite and is susceptible to attack by water vapors. This process requires great care during composite fabrication (i.e., hot pressing or infiltration) to minimize exposure to high temperatures (greater than 600° C.). Another problem with aluminum-based matrices is the strength of aluminum alloys decreases rapidly at temperatures above 350° C. This limits the practical maximum use temperature of these composites.

Nickel-Aluminide Matrix Methods

Nickel aluminides ranging in composition from NiAl to $Ni_3Al$ possess excellent high temperature strength and good oxidation resistance. These aluminide composites have superior elevated temperature matrices than polymer or aluminum matrices. In fact, $Ni_3Al$ precipitates are a strengthening phase of most nickel-base "superalloys".

Researchers have employed several methods of making fiber-reinforced nickel aluminide matrix composites. For example, V. K. Sikka et al. in "Processing and Mechanical Properties of $Ni_3Al$-Based Intermetallics" 1991 P/M Aerosp. Def. Technol. Proc., pp. 137 to 145 and Nishiyama et al. in "Fabrication and Mechanical Properties of Cf/NiAl and SiC/NiAl Composites" disclose a process of hot pressing nickel aluminide powder with carbon fiber. However, this method appears to result in extensive fiber breakage that weakens the final composite structure.

Brennan et al., in U.S. Pat. No. 3,953,647, disclose a method for hot pressing nickel-coated carbon fibers with powdered aluminum. The carbon fibers are electroplated with about a two micrometer thick layer of nickel and then the tow is infiltrated with a slurry of aluminum flakes in an organic liquid, dried and hot pressed. The main problem with this composite is lack of uniformity. When the aluminum powder size is the same or larger than the diameter of the fiber, a good uniformity of nickel and aluminum is difficult to achieve. Furthermore, this aluminum powder tends to fracture the carbon fibers upon pressure sintering.

It is object of this invention to develop composites that can operate at temperatures greater than 600° C.

It is a further object of this invention to develop an aluminum-base metal matrix composite containing carbon fibers that is free of detrimental quantities of $Al_4C_3$ phase.

It is a further object of this invention to provide a method of producing metal matrix composites containing long fibers.

SUMMARY OF THE INVENTION

The method provides a process for fabricating metal matrix composites. First the process coats the fibers with nickel by electrodeposition or gaseous deposition to form nickel-coated fibers. Over-plating the nickel-coated fibers with aluminum by either electrodeposition in a non-aqueous electrolyte or gaseous deposition forms aluminum-coated-nickel-coated fibers. Sintering this product under compression, perpendicular to the fiber's central axis, forms the final metal matrix composite. The metal matrix composite has a nickel-aluminum matrix, very few voids and extended unbroken lengths of fibers within the nickel-aluminum matrix.

DESCRIPTION OF PREFERRED EMBODIMENT

Figure 1:
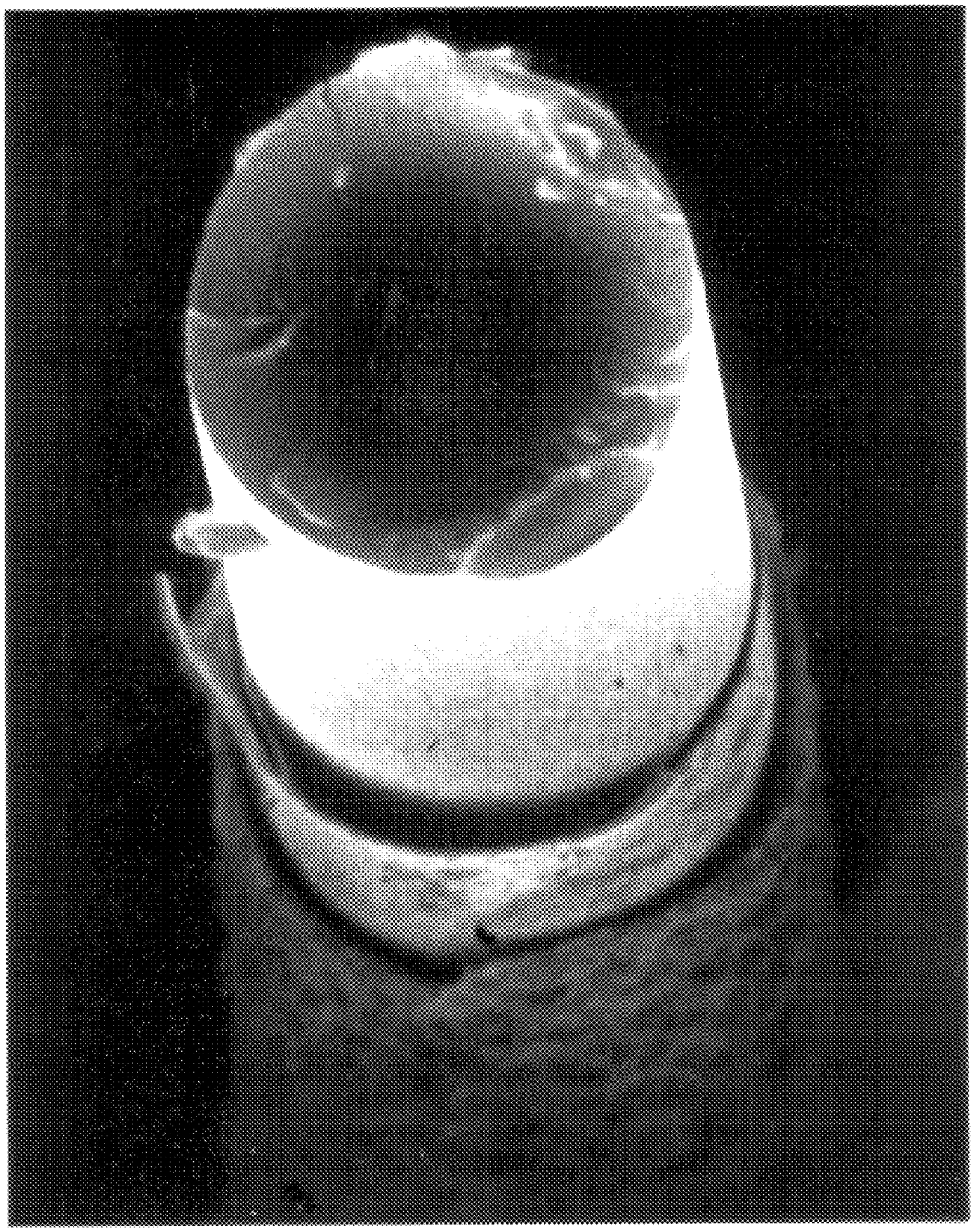
FIG. 1 illustrates a 7 μm carbon fiber coated by a 0.1 μm film of nickel then a 0.1 μm film of aluminum at 12,000×.

The following describes a new method of forming composites containing fiber components in nickel-aluminum matricies. The new method involves plating of fibers with nickel, plating of the nickel-coated fiber with aluminum, placing oriented parallel strands of the fiber bundles in a mold and hot pressing to reactively sinter the nickel and aluminum to form composites containing primarily long-unbroken fibers in matrices ranging in composition from NiAl to $Ni_3Al$. The article thus produced has excellent oxidation resistance and retains excellent physical properties to high temperatures as the carbon fibers do not react with the nickel aluminide. These carbon fiber nickel-aluminide metal matrix composites are particularly useful as gas turbine and compressor parts and in aerospace and aircraft composite structures.

In particular, the process begins by plating fibers with nickel. Since this process avoids the detrimental $Al_4C_3$ phase, it is particularly useful for carbon fiber-containing composites. This method is also applicable to other fibers such as SiC, alumina-base, silica-base and alumina-silica-base fibers. Nickel-coated carbon fibers have been commercially produced in the past by electroplating nickel onto the fibers and are currently produced by Inco Limited by thermal decomposition (CVD) of nickel carbonyl gas. Advantageously, nickel-coated fibers contain between about 15 and 85 weight percent nickel based on total mass. Most advantageously, these fibers contain about 30 to 75 weight percent nickel. The nickel coating is uniform around each fiber in the fiber tow. It is also possible to electrodeposit nickel on the fiber. This process however has less throwing power and results in a less uniform deposit. The gas deposition and electrodeposition techniques produce uniform smooth deposits that facilitate subsequent production of long fiber composites.

Second, the process over-plates the nickel-coated fiber with aluminum. This over-plating process must also consist of electrodepositing or vapor depositing the aluminum. These processes also deposit a uniform aluminum coating that allows compressive sintering without fracturing the fibers. Although satisfactory, electrodepositing with aluminum requires a non-aqueous electrolyte, such as an organic electrolyte or a fused salt bath. Unfortunately, these non-aqueous processes do not have good throwing power and are expensive to operate. Advantageously, the method of aluminum over-plating employs thermal decomposition of an organometallic-aluminum compound, such as the trialkyls of aluminum or the dialkyl aluminum hydrides. To maintain a gaseous compound, the organometallic-aluminum compound advantageously contains between 1 and 4 carbon atoms. The preferred organometallic-aluminum compound consists of triisobutyl-aluminum, triethyl-aluminum, tripropyl-aluminum, diethyl-aluminum hydride, diisobutyl-aluminum hydride and mixtures of these gases. Most advantageously, the method relies upon decomposition of triisobutyl-aluminum. The most advantageous temperature for decomposing the triisobutyl-aluminum gas is at temperatures between 100 and 310° C. The most advantageous temperature for decomposing this gas is at a temperature between 170° C. and 290° C. The thermal decomposing of the aluminum-bearing gas takes less than one hour to coat a 7 μm nickel-coated carbon fibers coated with 50 wt % nickel with a volume of the aluminum equal to the volume of the nickel. Most advantageously, the entire aluminum coating occurs in less than ten minutes of decomposing time. Acceptable gas concentrations range from 5 to 100 vol. % triisobutyl-aluminum. During gas decomposition, the chamber typically contains between 20 and 60 vol. % triisobutyl-aluminum gas.

An understanding of the invention will become more apparent to those skilled in the art by reference to the following detailed descriptions of the following Example:

EXAMPLE 1

Hercules AS4C grade fiber with an ultimate tensile strength of around 550,000 psi that had been plated with nickel to a level of 75 wt. % nickel was obtained as a 12 thousand filament tow from Inco Limited. A radiant reactor was constructed to coat these fibers by thermal decomposition of triisobutyl-aluminum. The triisobutyl-aluminum was vaporized into a mixture of nitrogen and isobutylene gas and thermally decomposed at approximately 200° C. onto precut length of the fiber. The aluminum successfully coated each fiber in the tow. Referring to FIG. 1, fracturing a single fiber illustrated a core consisting of the carbon fiber 7 micrometers in diameter. The next layer was the pure nickel layer and the outer layer was pure aluminum. The fracturing of the fiber tore the ductile nickel and aluminum layers away from the carbon core. The tow remained flexible, which is important to subsequent methods of production of articles with multiple curvations.

Lengths of the doubly plated tow containing 0.8 g/m of carbon of 12 k tow 2.2 g/m nickel and 0.7 g/m of aluminum were cut into 6 cm lengths and placed in a graphite die within a rectangular slot 6.4×1.3 cm wide. A mating graphite die that fit into the slot was placed on top of the fiber.

Figure 2:
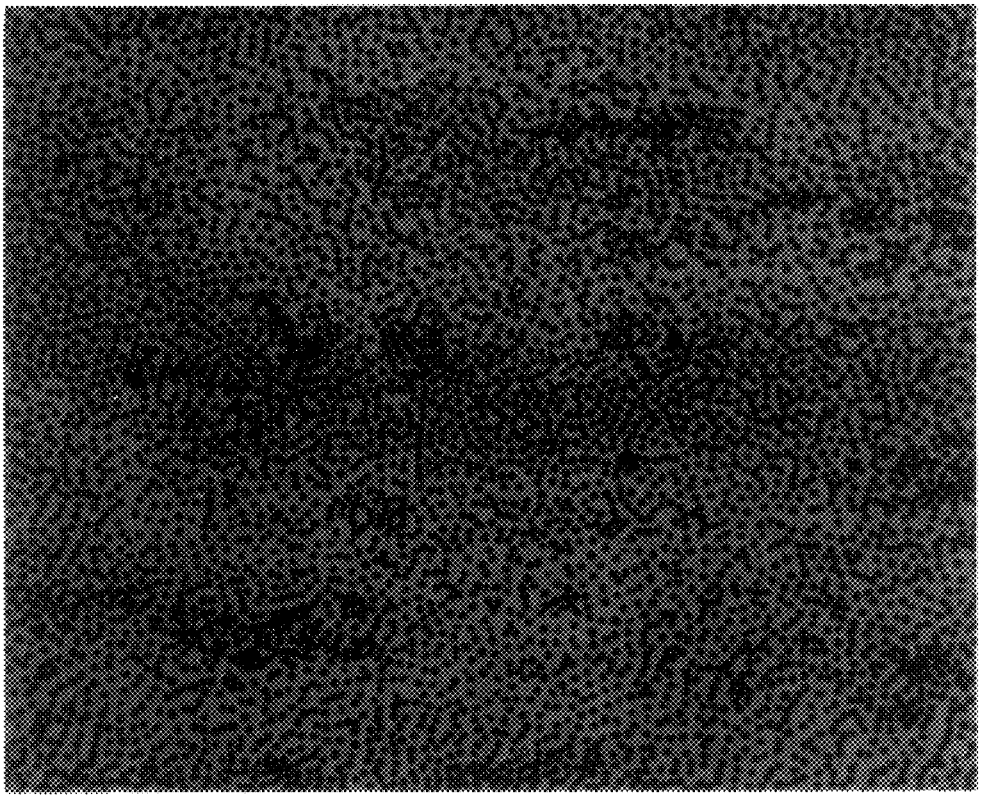
FIG. 2 illustrates a cross section of sintered aluminum-coated-nickel-coated carbon fibers at 150×.

The sample was vacuum hot pressed perpendicular to the fibers at 1200° C. for 1 hr. and subjected to a compression pressure of 15 MPa. The resultant article was essentially solid and contained about 50 vol. % carbon fiber and the matrix consisted of 75 wt. % nickel (60 atom % Ni) and 25 wt. % aluminum (40 atom % Al). Referring to FIG. 2, across section of the sintered article, illustrates the product to be uniform and fully dense. The density of the material was measured at 3.57 g/cm$^3$. The ultimate room temperature tensile strength of this specimen, 0.8 mm thick, was 110,000 psi (760 MPa), as measured in a three point bend test.

Controlling the amounts of nickel and aluminum in the carbon fiber produces the desired volume fraction of carbon and the composition of the nickel aluminide matrix. Compressing the uniformly coated fibers perpendicular to their central axis produces a nickel aluminide matrix having long unbroken fibers. These unbroken fibers advantageously have an average length of at least 20 times their average diameter before plating. Most advantageously, these fibers have an average length of at least 100 times their average diameter before plating.

Advantageously, the matrix contains 3 to 58 atomic percent aluminum and a balance consisting essentially of nickel. Most advantageously, this matrix contains 20 to 50 atomic percent aluminum. Advantageously, the fibers consist of 10 to 80 volume percent of the metal matrix composite. Most advantageously, the composite contains 15 to 70 volume percent fibers.

Increasing the volume fraction of carbon reduces the bulk density of this product. For high temperature aerospace applications, this composite most advantageously has a density less than about 4 g/cm$^3$. Articles produced by the method of the invention are stable at higher temperatures than titanium and may have a lower density than titanium-base alloys. This is particularly useful for high-temperature aerospace applications.

The invention provides a metal matrix composite stable at temperatures above 600° C. Furthermore, the matrix does not react with carbon fibers to form detrimental quantities of $Al_4C_3$ phase. Hot pressing the aluminum-coated-nickel-coated fibers produces low porosity metal matrix composites having long unbroken fibers. Finally, this process has the unique capability of producing low-density composite sheets useful for high temperature aerospace applications.

In accordance with the provisions of the statute, the specification illustrates and describes specific embodiments of the invention. Those skilled in the art will understand that changes may be made in the form of the invention covered by the claims; and that certain features of the invention may sometimes be used to advantage without a corresponding use of the other features.

We claim:

1. A method of fabricating a metal matrix composite comprising the steps of:

(a) plating fibers with nickel to form nickel-coated fibers, said plating consisting of a nickel coating process selected from the group consisting of electrodeposition and gaseous deposition, said fibers having a center axis;

(b) over-plating said nickel-coated fibers with aluminum to form aluminum-coated-nickel-coated fibers, said over-plating consisting of an aluminum coating process selected from the group consisting of electrodeposition in a non-aqueous electrolyte and gaseous deposition; and (c) sintering said aluminum-coated-nickel-coated fibers aligned in parallel under compression to form a nickel-aluminum matrix composite containing from 15 to 70 volume percent fiber and a matrix alloy containing about 3 to 58 atomic percent aluminum and a balance consisting essentially of nickel, and to eliminate voids, said compression being substantially perpendicular to said center axis of said fibers to maintain extended unbroken lengths of fibers in said nickel-aluminum matrix composite.

2. The method of claim 1 wherein said plating of said fibers with nickel consists of thermal decomposing nickel carbonyl to coat said fibers with nickel.

3. The method of claim 1 wherein said over-plating of aluminum consists of thermal decomposing an organometallic-aluminum compound on said nickel-coated fibers.

4. The method of claim 1 wherein said sintering occurs in a controlled atmosphere to limit oxidation of said nickel-aluminum matrix composite and said controlled atmosphere is selected from the group consisting of an inert atmosphere and a partial vacuum.

5. The method of claim 1 wherein said plating coats said fibers constructed of a material selected from the group consisting of carbon, silicon carbide, alumina, alumina-base, silica-base and alumina-silica-base.

6. The method of claim 1 wherein said sintering forms said unbroken lengths of fibers having an average length of at least 20 times the average diameter of said fibers before said plating.

7. The method of claim 1 wherein said nickel-aluminum matrix formed from said sintering contains nickel aluminide.

8. A method of fabricating a metal matrix composite comprising the steps of:

(a) plating carbon fibers with nickel to form nickel-coated carbon fibers, said plating consisting of a nickel coating process selected from the group consisting of electrolytic plating and gaseous deposition, said carbon fibers having a center axis;

(b) over-plating said nickel-coated carbon fibers with aluminum to form aluminum-coated-nickel-coated carbon fibers; said over-plating consisting of an aluminum coating process selected from the group consisting of electrodeposition in a non-aqueous electrolyte and gaseous deposition; and (c) sintering said aluminum-coated-nickel-coated carbon fibers aligned in parallel under compression to form a nickel-aluminum matrix composite containing from 15 to 70 volume percent carbon fiber and a matrix alloy containing about 3 to 58 atomic percent aluminum and a balance consisting essentially of nickel, and to eliminate voids, said compression being substantially perpendicular to said center axis of said carbon fibers to maintain extended unbroken lengths of carbon fibers in said nickel-aluminum matrix composite.

9. The method of claim 8 wherein said plating of said fibers with nickel consists of thermal decomposing nickel carbonyl to coat said fibers with nickel.

10. The method of claim 8 wherein said over-plating of aluminum consists of thermal decomposing an organometallic-aluminum compound selected from the group consisting of trialkyl-aluminum and dialkyl-aluminum hydrides on said nickel-coated fibers and said organometallic-aluminum compound contains 1 to 4 carbon atoms.

11. The method of claim 10 wherein said organometallic-aluminum compound is a gas selected from the group consisting of triisobutyl-aluminum, triethyl-aluminum, tripropyl-aluminum, diethyl-aluminum hydride, diisobutyl-aluminum hydride and mixtures of said gases.

12. The method of claim 11 wherein said gas is triisobutyl-aluminum decomposed at a temperature between 100° C. and 310° C.

13. The method of claim 8 wherein said sintering occurs in a controlled atmosphere to limit oxidation of said nickel-aluminum matrix composite and said controlled atmosphere is selected from the group consisting of an inert atmosphere and a partial vacuum.

14. The method of claim 8 wherein said sintering forms said unbroken carbon fibers having an average length of at least 20 times the average diameter of said fibers before said plating.

15. The method of claim 8 wherein said nickel-aluminum matrix formed from said sintering contains nickel aluminide.

16. The method of claim 8 wherein said sintering forms a matrix containing 20 to 50 atomic percent aluminum.

* * * * *